US008508525B2

(12) United States Patent
Komiya et al.

(10) Patent No.: US 8,508,525 B2
(45) Date of Patent: Aug. 13, 2013

(54) DISPLAY DEVICE AND DRIVING METHOD THEREOF

(75) Inventors: Naoaki Komiya, Yongin (KR); Choon-Yul Oh, Yongin (KR); Joo-Hyeon Jeong, Yongin (KR); Myoung-Hwan Yoo, Yongin (KR); Wang-Jo Lee, Yongin (KR); Ho-Ryun Chung, Yongin (KR); Chang-Ho Hyun, Yongin (KR); Woung Kim, Yongin (KR); In-Ho Choi, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 274 days.

(21) Appl. No.: 12/929,223

(22) Filed: Jan. 10, 2011

(65) Prior Publication Data

US 2011/0279436 A1 Nov. 17, 2011

(30) Foreign Application Priority Data

May 11, 2010 (KR) ..... 10-2010-0044159

(51) Int. Cl.
*G09G 5/00* (2006.01)

(52) U.S. Cl.
USPC ..... 345/212; 345/76; 345/77; 345/211

(58) Field of Classification Search
USPC ..... 345/76, 77, 211, 212, 213
See application file for complete search history.

(56) References Cited

U.S. PATENT DOCUMENTS

| | | | | |
|---|---|---|---|---|
| 2008/0180365 | A1* | 7/2008 | Ozaki | 345/76 |
| 2009/0051628 | A1* | 2/2009 | Kwon | 345/77 |
| 2009/0058770 | A1* | 3/2009 | Liu et al. | 345/77 |
| 2009/0066686 | A1* | 3/2009 | Ryu | 345/213 |

FOREIGN PATENT DOCUMENTS

| | | | |
|---|---|---|---|
| KR | 10 2006-0072784 | A | 6/2006 |
| KR | 10-0666647 | B1 | 1/2007 |
| KR | 10 2008-0080734 | A | 9/2008 |
| KR | 10 2009-0080270 | A | 7/2009 |
| KR | 10 2009-0104773 | A | 10/2009 |
| KR | 10 2009-0105838 | A | 10/2009 |

* cited by examiner

*Primary Examiner* — Amare Mengistu
*Assistant Examiner* — Premal Patel
(74) *Attorney, Agent, or Firm* — Lee & Morse, P.C.

(57) ABSTRACT

An organic light emitting diode (OLED) display includes a display unit including a plurality of pixels, a plurality of scan lines, and a plurality of data lines, a data driver transmitting a plurality of data signals to the plurality of data lines, a scan driver transmitting a plurality of scan signals to the plurality of scan lines, a compensation controller supplying a predetermined first current to each OLED in each of the plurality of pixels during a sensing period for measuring a driving voltage of the OLED for each of a plurality of pixels, receiving the driving voltage of the OLED supplied with the first current, and outputting measuring data for the transmitted driving voltage; and a signal controller compensating an input video signal according to the measuring data to generate image data. The compensation controller is separate from and external to the data driver.

18 Claims, 10 Drawing Sheets

DISPLAY DEVICE AND DRIVING METHOD THEREOF

BACKGROUND

1. Field

Embodiments relate to an organic light emitting diode (OLED) display. More particularly, embodiments relate to an organic light emitting diode (OLED) display and a driving method thereof capable of displaying images of an uniform luminance by compensating deterioration of an organic light emitting diode (OLED).

2. Description of the Related Art

Various kinds of flat display devices that are capable of reducing detriments of cathode ray tubes CRT, such as their heavy weight and large size, have been developed in recent years. Such flat display devices include liquid crystal displays LCDs, field emission displays FEDs, plasma display panels PDPs, and organic light emitting diode (OLED) displays.

Among the above flat panel displays, OLED displays using an OLED generate light by a recombination of electrons and holes for the display of images have a fast response speed, are simultaneously driven with low power consumption, and have excellent luminous efficiency, luminance, and viewing angle. Generally, the OLED displays are classified into passive matrix OLED (PMOLED) displays and active matrix OLED (AMOLED) displays according to a driving method of the OLED. AMOLED displays, in which unit pixels are selectively lit, are primarily used due to better resolution, contrast, and operation speed.

If the OLED deteriorates, the resistance thereof increases and the luminous efficiency thereof decreases. Thus, the luminance may be deteriorated even if the same current is applied to the OLED.

The above information disclosed in this Background section is only for enhancement of understanding of the background of the invention and therefore it may contain information that does not form the prior art that is already known in this country to a person of ordinary skill in the art.

SUMMARY

Embodiments are therefore directed to an organic light emitting diode (OLED) display and a driving method thereof, which substantially overcome one or more of the problems due to the limitations and disadvantages of the related art.

It is therefore a feature of an embodiment to provide an OLED display and a driving method thereof that are capable of realizing a desired luminance regardless of deterioration of the organic light emitting diode by detecting and compensating deterioration of the organic light emitting diode including each pixel of an OLED display in real time.

It is another feature of an embodiment to provide an OLED display and a driving method thereof in which the driving voltage of the organic light emitting diode is measured using one converter and one current source such that compensation error may be prevented.

It is another feature of an embodiment to provide an OLED display and a driving method thereof, in which the converter and the current source are disposed outside the data driver, such that, in the case of a plurality of data drivers, the number of converters and current sources is not increased and compensation error may be prevented.

At least one of the above and other features and advantages may be realized by providing an organic light emitting diode (OLED) display according to an exemplary embodiment of the present invention includes: a display unit including a plurality of pixels, a plurality of scan lines, and a plurality of data lines; a data driver transmitting a plurality of data signals to the plurality of data lines; a scan driver transmitting a plurality of scan signals to the plurality of scan lines; a compensation controller supplying a predetermined first current to each organic light emitting diode in each of the plurality of pixels during a sensing period for measuring a driving voltage of the organic light emitting diode for each of the plurality of pixels, receiving the driving voltage of the organic light emitting diode supplied with the first current, and outputting measuring data for the transmitted driving voltage; and a signal controller compensating an input video signal according to the measuring data to generate image data. The compensation controller is separate from and external to both the first and second data drivers The compensation controller may be connected to one data line of the plurality of data lines during the sensing period, and may detect the driving voltage of at least one organic light emitting diode among the plurality of organic light emitting diodes connected to one data line.

The display device may further include a selection unit including: a plurality of compensating switches including one terminal connected to the corresponding data line of the plurality of data lines and the other terminal connected to the compensation controller; a plurality of data transmitting switches including one terminal connected to the corresponding data line of the plurality of data lines and the other terminal connected to the data driver; and a selection driver turning on the plurality of compensating switches during the sensing period, and turning on the plurality of data transmitting switches during the image display period in which the plurality of data lines are transmitted with the plurality of data signals.

The display device may further include a plurality of sensing driving lines and a sensing driver respectively transmitting a plurality of detection signals to the corresponding sensing driving line according to the sensing control signal, wherein the driving voltage of the organic light emitting diode of each of the plurality of pixels may be transmitted to the compensation controller during the sensing period of the plurality of detection signals. The plurality of detection signals may respectively have a pulse of a first level during the sensing period, and the plurality of first switches may be turned on during a period in which the detection signal has the pulse of the first level.

The compensation controller may include a current source supplying the test current to the plurality of data lines during the sensing period, and a converter digital-converting the driving voltage of the organic light emitting diode transmitted through the plurality of data lines during the sensing period to output the measuring data.

An organic light emitting diode (OLED) display according to another exemplary embodiment of the present invention includes: a display unit including a plurality of pixels, a plurality of scan lines, and a plurality of data lines; a first data driver transmitting a plurality of corresponding data signals to the plurality of first data lines of the plurality of data lines; a second data driver transmitting a plurality of corresponding data signals to the plurality of second data lines of the plurality of data lines except for the plurality of first data lines; a scan driver transmitting a plurality of scan signals to the plurality of scan lines; a compensation controller supplying a predetermined first current to each organic light emitting diode in each of the plurality of pixels during a sensing period for measuring a driving voltage of the organic light emitting diode for each of the plurality of pixels, receiving the driving voltage of the organic light emitting diode supplied with the first current, and outputting measuring data for the transmitted driving voltage; a first selection unit connecting the plurality of first data lines to the compensation controller during a first sensing period of the sensing period; a second selection unit connecting the plurality of second data lines to the compensation controller during a second sensing period of the sensing period; and a signal controller compensating an input video signal according to the measuring data to generate image data. The compensation controller is separate from and external to both the first and second data drivers.

The display device may further include a plurality of sensing driving lines and a sensing driver transmitting a plurality of detection signals corresponding to the plurality of sensing driving lines during the sensing period.

The first selection unit may include a plurality of first compensating switches including one terminal connected to the first data lines and the other terminal connected to the compensation controller, and a plurality of first data transmitting switches including one terminal connected to the first data lines and the other terminal receiving the corresponding data signal from the data driver. The sensing driver may transmit a detection signal corresponding to the first level to measure the driving voltage of the organic light emitting diode corresponding to one sensing driving line of the plurality of sensing driving lines during the sensing period, the period in which the corresponding detection signal is the first level includes the first sensing period and the second sensing period, and the first selection unit may turn on the plurality of first compensating switches during the first sensing period.

The second selection unit may include a plurality of second compensating switches including one terminal connected to the second data lines and the other terminal connected to the compensation controller, and a plurality of second data transmitting switches including one terminal connected to the second data lines and the other terminal receiving the corresponding data signal from the data driver. The sensing driver may transmit a detection signal corresponding to the first level to measure the driving voltage of the organic light emitting diode corresponding to one sensing driving line of the plurality of sensing driving lines during the sensing period, the period in which the corresponding detection signal is the first level includes the first sensing period and the second sensing period, and the second selection unit may turn on the plurality of second compensating switches during the second sensing period.

BRIEF DESCRIPTION OF THE DRAWINGS

The above and other features and advantages will become more apparent to those of ordinary skill in the art by describing in detail exemplary embodiments with reference to the attached drawings, in which.

DETAILED DESCRIPTION

Figure 1:
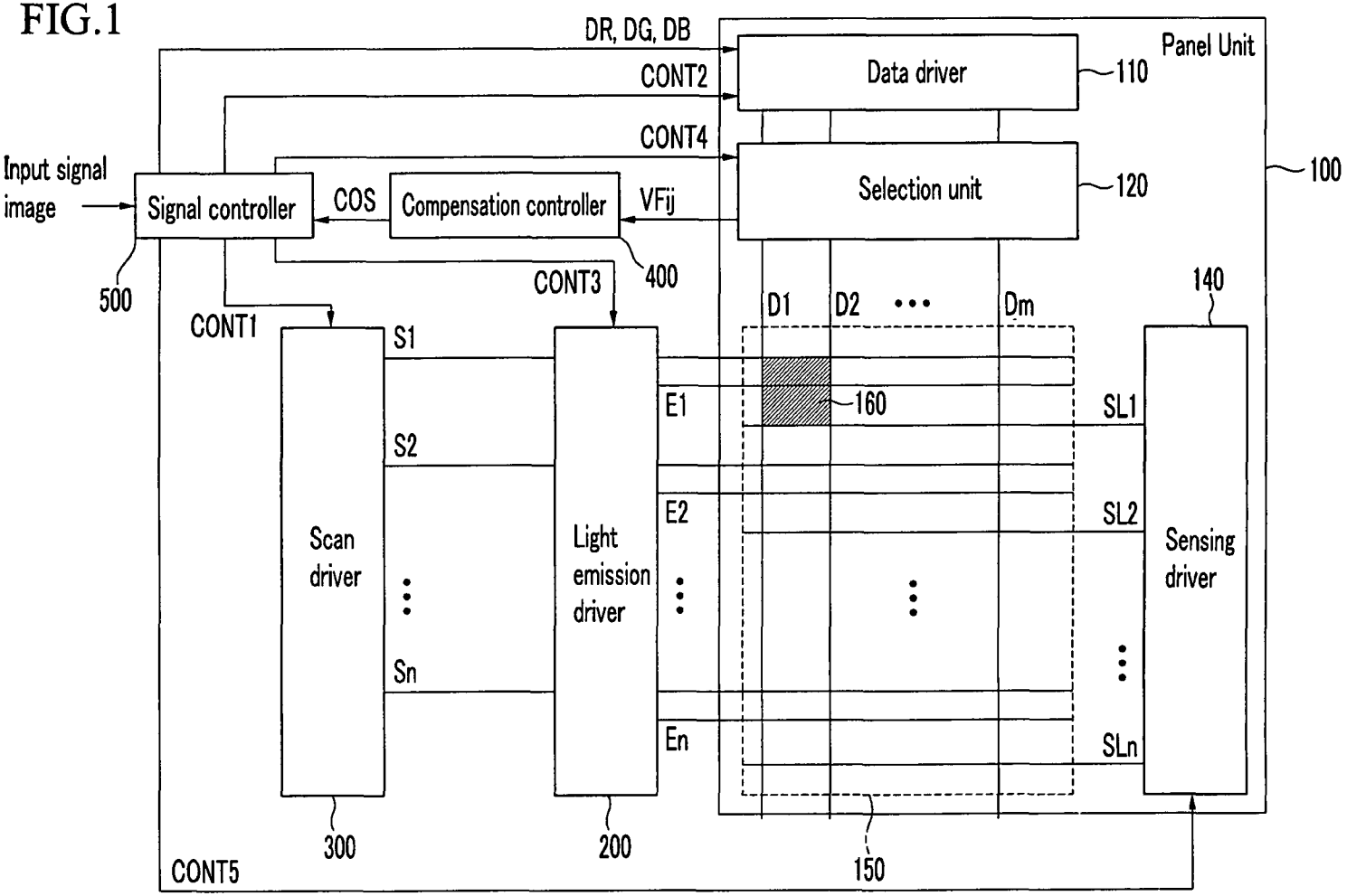
FIG. 1 illustrates a block diagram of a display device according to an exemplary embodiment.

Korean Patent Application No. 10-2010-0044159, filed on May 11, 2010, in the Korean Intellectual Property Office, and entitled: "Display Device," is incorporated by reference herein in its entirety.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

Referring to FIG. 1, a display device according to an exemplary embodiment may include a panel unit 100, a light emission driver 200, a scan driver 300, a compensation controller 400, and a signal controller 500. The panel unit 100 may include a display unit 150, a data driver 110, a selection unit 120, and a sensing driver 140

The display unit 150 may include a plurality of scan lines S1-Sn, a plurality of light emission control lines E1-En, a plurality of sensing lines SL1-SLn, a plurality of data lines D1-Dm, and a plurality of pixels 160. The plurality of scan lines S1-Sn, the plurality of light emission control lines E1-En, and the plurality of sensing lines SL1-SLn extend substantially in a row direction and are substantially parallel to each other. The plurality of data lines D1-Dm extend substantially in a column direction and are substantially parallel to each other. The plurality of pixels 160 are respectively connected to the corresponding scan lines among the plurality of scan lines S1-Sn, the corresponding light emission control lines among the plurality of light emission control lines E1-En, the corresponding data lines among the plurality of data lines D1-Dm, and the corresponding sensing lines among the plurality of sensing lines SL1-SLn, and are arranged in an approximate matrix.

The data driver 110 is connected to the plurality of data lines D1-Dm of the display unit 150, and converts image data DR, DG, and DB input from the signal controller 500 into a plurality of data voltages according to a data control signal CONT2 to apply them to the plurality of data lines D1-Dm.

The selection unit 120 connects the plurality of data lines D1-Dm to the compensation controller 400 or the data driver 110 according to a selection control signal CONT4. In detail, the selection unit 120 sequentially connects the compensation controller 400 and the plurality of data lines D1-Dm to measure the driving voltage of the organic light emitting diode generated when a predetermined test current It is applied to each organic light emitting diode of the plurality of pixels. The selection unit 120 connects the data driver 110 and the plurality of data lines D1-Dm during a period in which the image is displayed according to the video signal. The detailed configuration of the selection unit 120 will be described later with reference to FIG. 3.

The sensing driver 140 is connected to the plurality of sensing lines SL1-SLn of the display unit 150, and sequentially applies a plurality of detection signals Sen[1]-Sen[n] to the plurality of sensing lines SL1-SLn according to a sensing control signal CONT5. The test current It is transmitted to the pixel connected to the sensing lines SL1-SLn receiving the detection signal and the data line selected by the selection unit 120 among the plurality of pixels. Thus, the driving voltage VFij of the organic light emitting diode of the pixel receiving the test current It is transmitted to the compensation controller 400.

The light emission driver 200 respectively transmits a plurality of light emission control signals Em[1]-Em[n] to a plurality of light emission control lines E1-En according to a light emission control signal CONT3. The scan driver 300 is connected to the scan lines S1-Sn of the display unit 150, and sequentially applies a plurality of scan signals Sel[1]-Sel[n] to the plurality of scan lines S1-Sn according to a scan control signal CONT1.

Figure 4:
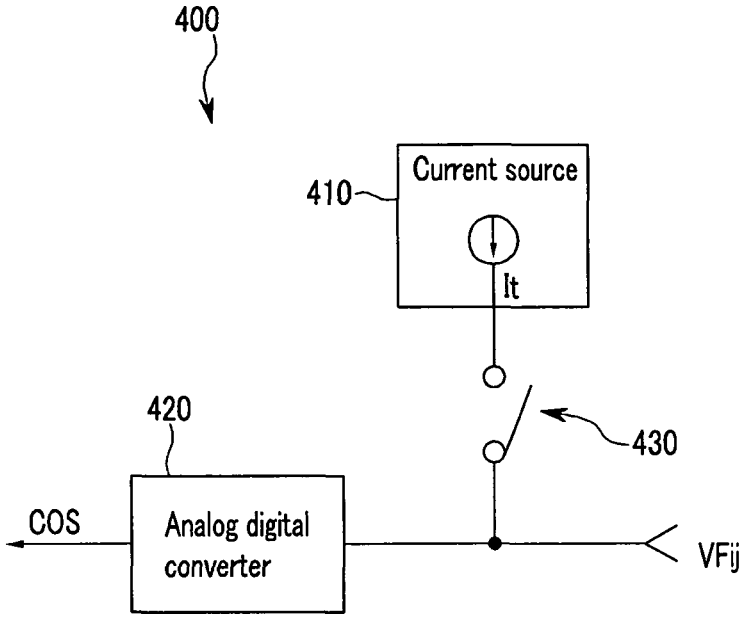
FIG. 4 illustrates a configuration of a compensation controller shown in FIG. 1 according to an exemplary embodiment.

The compensation controller 400 will be described in detail later with reference to FIG. 4.

The signal controller 500 receives the signals from the outside to generate the image data DR, DG, and DB, the scan control signal CONT1, the data control signal CONT2, the light emission control signal CONT3, the selection control signal CONT4, and the sensing control signal CONT5. Also, the signal controller 500 stores the relationship between the information of the driving voltages as the voltages of both terminals of the organic light emitting diode and the data signal compensation information corresponding thereto as a table when the predetermined current flows in the organic light emitting diode. The signal controller 500 receives the information for the driving voltage of the organic light emitting diode transmitted from the compensation controller 400, detects the data signal compensation information corresponding to the information for the transmitted driving voltage, and to compensates the input video signal to generate the image data signal DR, DG, and DB in accordance with the compensation information.

Figure 2:
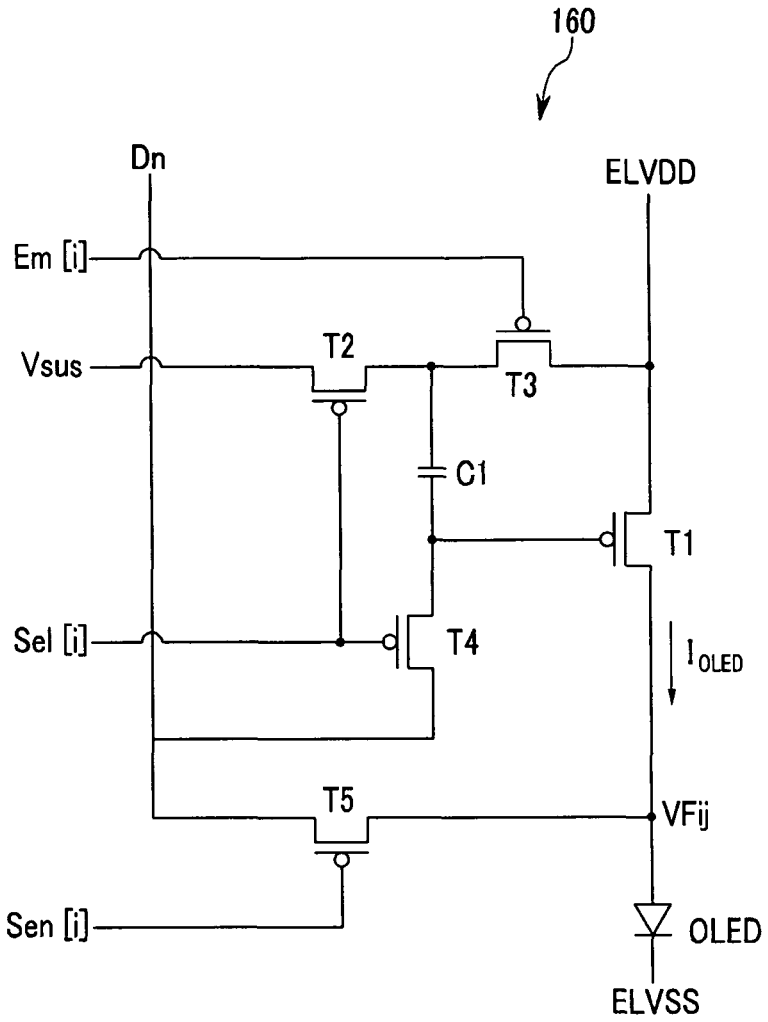
FIG. 2 illustrates a circuit diagram of a pixel configuration shown in FIG. 1 according to an exemplary embodiment.

Referring to FIG. 2, each pixel 160 includes an organic light emitting diode OLED connected to the i-th (i is a natural number from 1 to n) scan line Si, the j-th (j is the natural number from 1 to m) data line Dj, a driving transistor T1, a capacitor C1, a sustain voltage transistor T2, a light emitting transistor T3, a scan transistor T4, and a sensing transistor T5.

The driving transistor T1 includes a source terminal receiving the driving voltage ELVDD, a drain terminal connected to an anode terminal of the organic light emitting diode OLED, and a gate terminal.

The scan transistor T4 includes a source terminal connected to the data line Dn, a gate terminal receiving the scan signal, and a drain terminal connected to the gate terminal of the driving transistor T1.

The sustain voltage transistor T2 includes a gate terminal connected to the scan line, a drain terminal receiving the sustain voltage Vsus, and a source terminal connected to a source terminal of the light emitting transistor T3.

The light emitting transistor T3 includes a gate terminal connected to the light emission control line Ei, the source terminal connected to the source terminal of the sustain voltage transistor T2, a gate terminal connected to the light emission control line Ei, and a drain terminal receiving the driving voltage ELVDD.

The sensing transistor T5 includes a gate terminal connected to the sensing lines SLi, a source terminal connected to the anode of the organic light emitting diode OLED, and a drain terminal connected to the data line Dj.

The organic light emitting diode OLED includes the anode connected to the drain terminal of the driving transistor T1 and a cathode connected to the common voltage ELVSS. The organic light emitting diode OLED emits light having different intensities depending on the driving current $I_{OLED}$ supplied from the driving transistor T1, thereby displaying images.

The organic light emitting diode OLED can emit light of one of primary colors. The primary colors may include, for example, three primary colors of red, green, and blue, and a desired color can be displayed with a spatial or temporal combination of the primary colors. Some of the organic light emitting diodes may emit white light so as to increase luminance. Alternatively, the organic light emitting diode at all of the pixels PX may emit white light. In this case, some of the pixels PX may further include a color filter (not shown) for converting white light from the organic light emitting element into any one of the primary colors.

The driving transistor T1, the sustain voltage transistor T2, the light emitting transistor T3, the scan transistor T4, and the sensing transistor T5 may be p-channel field effect transistors (FETs). However, at least one of the driving transistor T1, the sustain voltage transistor T2, the light emitting transistor T3, the scan transistor T4, and the sensing transistor T5 may be an n-channel FET. Also, the connection relationship of the transistors T1, T2, T3, T4, and T5, the capacitor C1, and the organic light emitting diode may be changed. The pixel PXij shown in FIG. 2 illustrates an example of a pixel of a display device, and pixels having different structures with at least two transistors or at least one capacitor may be used instead.

Figure 3:
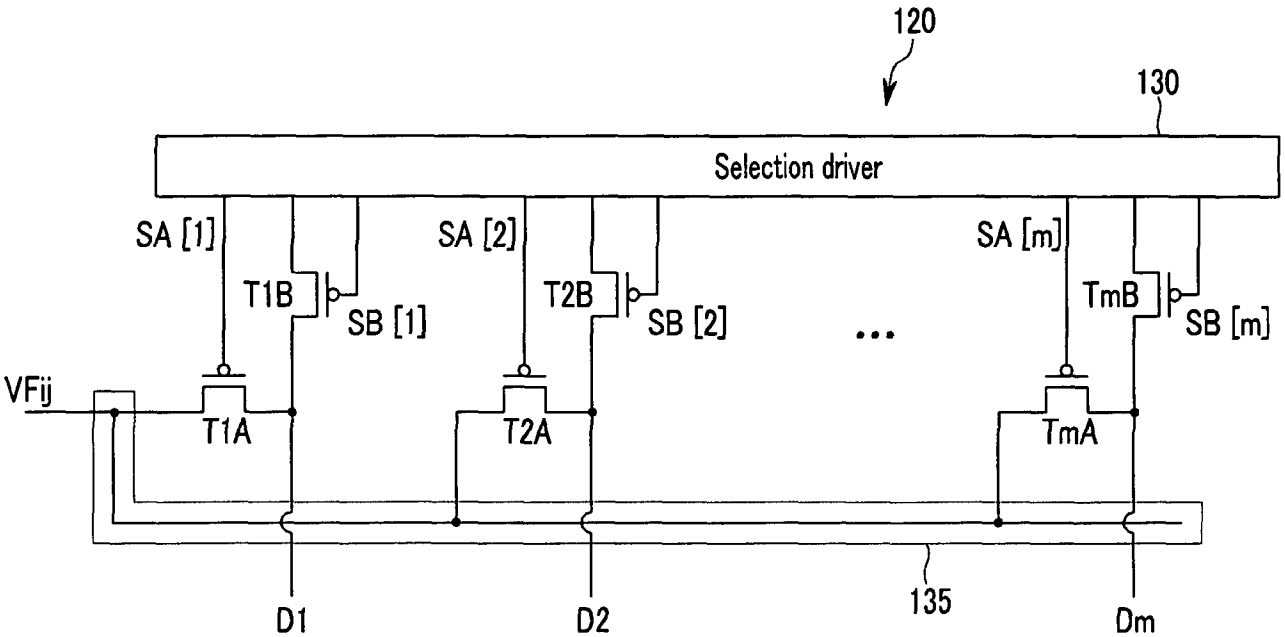
FIG. 3 illustrates a configuration of a selection unit shown in FIG. 1 according to an exemplary embodiment.

The selection unit 120 is described with reference to FIG. 3. The selection unit 120 sequentially connects the plurality of data lines to the compensation controller 400 during a sensing period for measuring the driving voltage VFij of the organic light emitting diode. The plurality of data lines D1-Dm are respectively connected to the data driver 110, and the plurality of data signals are respectively transmitted to the corresponding data lines during the period (hereinafter, image display period) in which the images are normally displayed.

The selection unit 120 includes a selection driver 130, a plurality of compensating switches TjA (j is a natural number from 1 to m), a plurality of data transmitting switches TjB (j is a natural number from 1 to m), and selection lines 135 providing current from a sensing period current source 410 (FIG. 4) to the organic light emitting diode OLED.

The selection driver 130 turns on all of the plurality of data transmitting switches during the image display period, and turns them off during the sensing period. Also, the selection driver 130 turns on the plurality of compensating switches during the sensing period. Here, the turned-on period of the plurality of compensating switches may not overlap.

The compensating switch TjA includes a gate terminal receiving the compensating switch control signal SA[1]-SA[m] from the selection driver 130, a source terminal connected to the corresponding data line Dj, and a drain terminal receiving the test current It from the current source 410 of the compensation controller 400.

The data transmitting switch TjB includes a gate terminal receiving the data transmitting control signal, a drain terminal receiving the corresponding data signal from the data driver 110, and a source terminal connected to the corresponding data line Dj.

A detailed configuration of the compensation controller 400 is described with reference to FIG. 4. The compensation controller 400 may include one current source 410, an analog-to-digital converter 420, and a current switch 430. The converter 420 receives the driving voltage VFij data of the organic light emitting diode to convert the analog signal into the digital signal.

The current switch 430 is connected between the selection lines 135 and the current source 410. When the current switch 430 is turned on, the test current It of the current source 410 is transmitted to the selection lines 135. The current flowing in the selection lines 135 flows in the corresponding data line through the turned-on switch among the plurality of compensating switches T1A-TmA.

The converter 420 receives the driving voltage of the organic light emitting diode transmitted through the turned-on compensating switch among the plurality of compensating switches T1A-TmA, converts the driving voltage into the digital signal to generate deterioration data COS, and transmits deterioration data COS to the signal controller 500.

The signal controller 500 receives the deterioration data COS, detects the deterioration degree of the organic light emitting diode based on the deterioration data COS, and determines the compensation amount of the image data.

Figure 5:
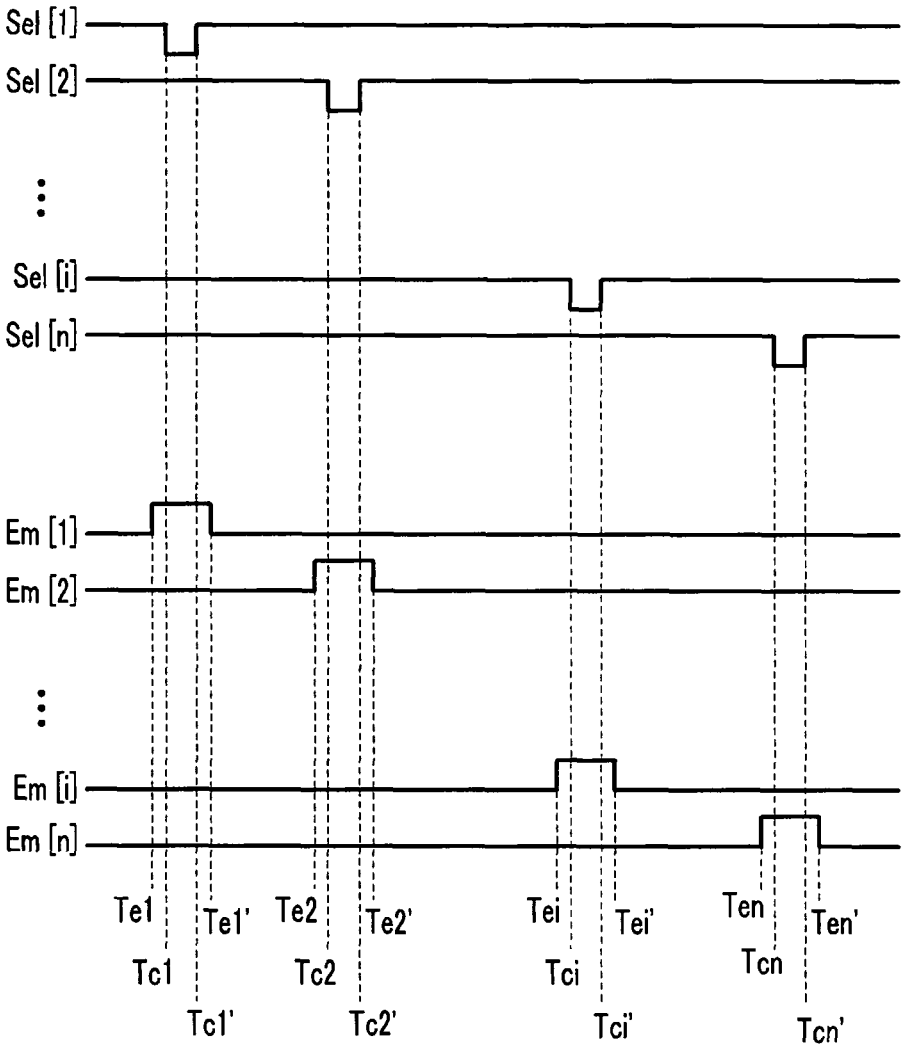
FIG. 5 to FIG. 7 illustrate waveforms of each signal according to an exemplary embodiment.

The operation of the period in which the image is displayed is described with reference to FIG. 5. As shown in FIG. 5, a plurality of scan signals sequentially become low during the image display period, thereby turning on the scan transistor T4. The plurality of scan signals that sequentially becomes low is transmitted to the gate electrode of the corresponding light emitting transistor T3. The corresponding scan transistor T4 turned-off when the scan signal is high, and the corresponding light emitting transistor T3 turned-on when the light emission control signal is low. As illustrated in FIG. 5, the period in which the light emission control signal is high completely overlaps the period in which the corresponding selection signal is low. However, embodiments are not limited thereto.

In the image display period, all of data selection signals SB[j] (j is a natural number from 1 to m) are low, and all of data transmitting switches TjB are turned on. Thus, the plurality of data voltages generated from the image data DR, DG, and DB are respectively applied to the plurality of corresponding data lines D1-Dm.

When the light emission control signal Em[i] becomes high at the time Tei, the light emitting transistor T3 is turned off. When the light emission control signal Em[i] becomes low again at time Tei', the light emitting transistor T3 is turned on. Thus, the light emitting transistor T3 is turned off during the period Tei-Tei'.

The scan transistor T4 and the sustain voltage transistor T2 operate in response to the scan signal Sel[i]. When the scan signal Sel[i] becomes low at time Tci, the scan transistor T4 and the sustain voltage transistor T2 are turned on. When the scan signal Sel[i] becomes high on at time Td, the scan transistor T4 and the sustain voltage transistor T2 are turned off Thus, the scan transistor T4 and the sustain voltage transistor T2 are on during the period Tci-Tci'.

When the scan transistor T4 is turned on, the driving current $I_{OLED}$ is generated by the driving transistor T1 according to the data signal transmitted through the data line Dj. The driving transistor T1 supplies the driving current $I_{OLED}$ determined according to the intensity of the voltage applied between the gate terminal and the source terminal to the organic light emitting diode. When the sustain voltage transistor T2 is turned on at the time Tci according to the scan signal Sel[i] becoming low, the sustain voltage Vsus and the data voltage are transmitted to respective terminals of the capacitor C1.

When the light emission control signal Em[i] becomes low at the time Tei', the light emitting transistor T3 is turned on such that the driving voltage ELVDD is transmitted to one terminal of the capacitor C1. Thus, the voltage of both terminals of the capacitor C1 is maintained as the difference between the data voltage and the driving voltage ELVDD until the new data voltage is written in the next frame.

The light emitting transistor T3 and the sustain voltage transistor T2 are not simultaneously turned on. Accordingly, a short circuit between the power source voltage and the assistance voltage is not generated.

Figure 6:
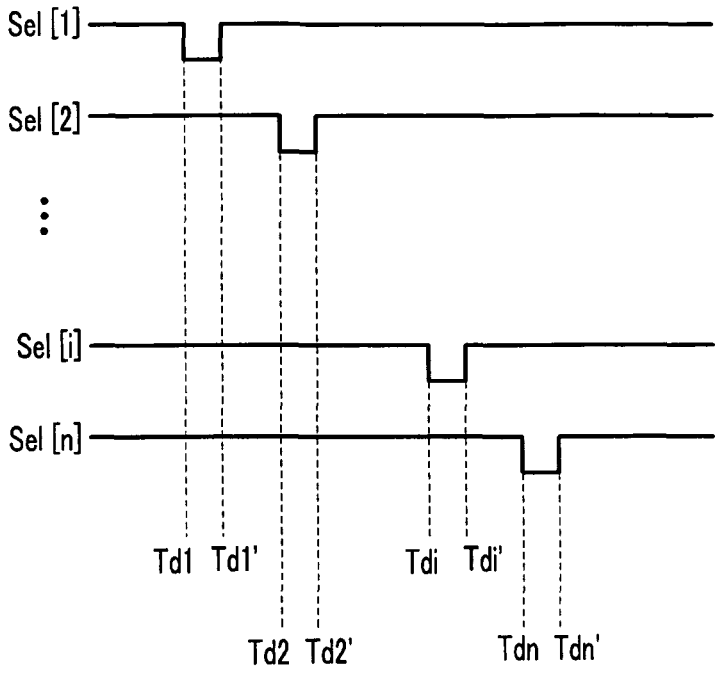
Figure 7:
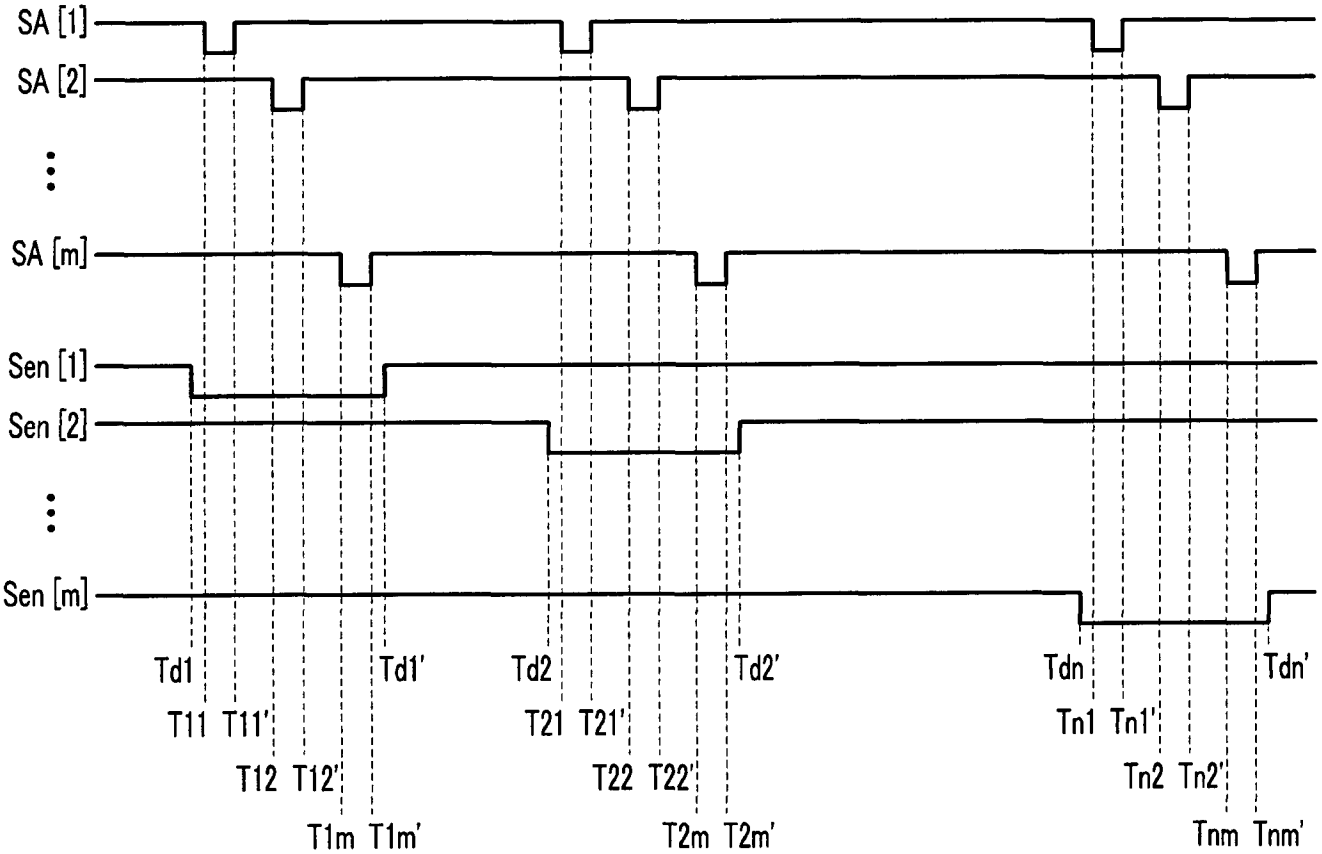

An operation during the sensing period is described with reference to FIG. 6 and FIG. 7.

When the detection signal Sen[1] becomes low at the time Td1 and remains low during the period Td1-Td1', all of the sensing transistors T5 connected to the first sensing lines SL1 are turned on.

When the selection signal SA[1] becomes low at the time T11 and remains low during the period T11-T11', the compensating switch T1A connected to the data line D1 is turned on during the period T11-T11'. Thus, the test current flows in the organic light emitting diode of the pixel connected to the data line D1 among the plurality of pixels connected to the first scan line, thereby transmitting the generated driving voltage VF11 of the organic light emitting diode at that time to the compensation controller 400.

Next, when the selection signal SA[2] becomes low at the time T12 and remains low during the period T12-T12', the compensating switch T2A connected to the data line D2 is turned on during the period T12-T12'. Thus, the test current flows in the organic light emitting diode of the pixel connected to the data line D2 among the plurality of pixels connected to the first scan line, thereby transmitting the driving voltage VF12 of the organic light emitting diode generated at that time to the compensation controller 400.

By repeating this operation, when the selection signal SA[m] is the low during the period T1*m*-T1*m*', the compensating switch TmA connected to the data line Dm is turned on during the period T1*m*-Tm1'. Thus, the test current flows in the organic light emitting diode of the pixel connected to the data line Dm among the plurality of pixels connected to the first scan line, thereby transmitting the driving voltage VF1*m* of the organic light emitting diode generated at that time to the compensation controller 400.

When the detection signal Sen[2] becomes low at the time Td2 and remains low during the period Td2-Td2', all of the sensing transistors T5 connected to the second sensing lines SL2 are turned on.

When the selection signal SA[1] becomes low at the time T21 and remains low during the period T21-T21', the compensating switch T1A connected to the data line D1 is turned on during the period T21-T21'. Thus, the test current flows in the organic light emitting diode of the pixel connected to the data line D1 among the plurality of pixels connected to the second scan line, thereby transmitting the driving voltage VF21 of the organic light emitting diode generated at that time to the compensation controller 400.

Next, when the selection signal SA[2] becomes low at the time T22 and remains low during the period T22-T22', the compensating switch T2A connected to the data line D2 is turned on during the period T22-T22'. Thus, the test current flows in the organic light emitting diode of the pixel connected to the data line D2 among the plurality of pixels connected to the second scan line, thereby transmitting the driving voltage VF22 of the organic light emitting diode generated at that time to the compensation controller 400.

By repeating this operation, when the selection signal SA[m] is low during the period T2*m*-T2*m*', the compensating switch TmA connected to the data line Dm is turned on during the period T2*m*-T2*m*'. Thus, the test current flows in the organic light emitting diode of the pixel connected to the data line Dm among the plurality of pixels connected to the second scan line, thereby transmitting the driving voltage VF2*m* of the organic light emitting diode generated at that time to the compensation controller 400.

When the detection signal Sen[n] becomes low at the time Tdn and remains low during the period Tdn-Tdn', all of the sensing transistors T5 connected to the n-th sensing lines SLn are turned on.

When the selection signal SA[1] becomes low at the time Tn1 and remains low during the period Tn1-Tn1', the compensating switch T1A connected to the data line D1 is turned on during the period Tn1-Tn1'. Thus, the test current flows in the organic light emitting diode of the pixel connected to the data line D1 among the plurality of pixels connected to the n-th scan line, thereby transmitting the driving voltage VFn1 of the organic light emitting diode generated at that time to the compensation controller 400.

Next, when the selection signal SA[2] becomes low at the time Tn2 and remains low during the period Tn2-Tn2', the compensating switch T2A connected to the data line D2 is turned on during the period Tn2-Tn2'. Thus, the test current flows in the organic light emitting diode of the pixel connected to the data line D2 among the plurality of pixels connected to the n-th scan line, thereby transmitting the driving voltage VFn2 of the organic light emitting diode generated at that time to the compensation controller 400.

By repeating this operation, when the selection signal SA[m] is low during the period Tnm-Tnm', the compensating switch TmA connected to the data line Dm is turned on during the period Tnm-Tnm'. Thus, the test current flows in the organic light emitting diode of the pixel connected to the data line Dm among the plurality of pixels connected to the n-th scan line, thereby transmitting the driving voltage VFnm of the organic light emitting diode generated at that time is transmitted to the compensation controller 400.

By this method, the total driving voltage of the organic light emitting diode is transmitted to the compensation controller such that the deterioration data COS of the data signal is transmitted to the signal controller 500. The deterioration degree of the organic light emitting diode is detected based on the deterioration data COS to determine the compensation amount of the image data. Through these processes, the total driving voltage of the organic light emitting diode may be measured, and portion thereof may be measured by controlling the signals if necessary.

Another exemplary embodiment of the present invention will be described with reference to FIG. 8.

When the panel unit 100 is a large panel, if there is only one selection driver 130, the load of the selection lines 135 increases during the sensing period. If the load of the selection lines 135 increases, the period for detecting the driving voltage of the organic light emitting diode through the selection driver 130 increases.

A display device according to another exemplary embodiment includes a plurality of data drivers 110-1 and 110-2 and a plurality of selection units 120-1 and 120-2 corresponding to the data drivers. Thus, the increasing of the sensing period due to an overload of the selection line may be prevented.

The selection units 120-1 and 120-2 according to another exemplary embodiment include selection drivers 130-1 and 130-2, a plurality of data transmitting switches S1*i*B and S2*j*B (i is a natural number from 1 to m, and j is a natural number from 1 to k), and a plurality of compensating switches S1*i*A and S2*j*A (i is a natural number from 1 to m, and j is a natural number from 1 to k). Each selection unit 120-1 and 120-2 are similar to the selection unit 120 of the previous exemplary embodiment. Here, the description of the detail configuration of the selection units 120-1 and 120-2 is not repeated.

Figure 8:
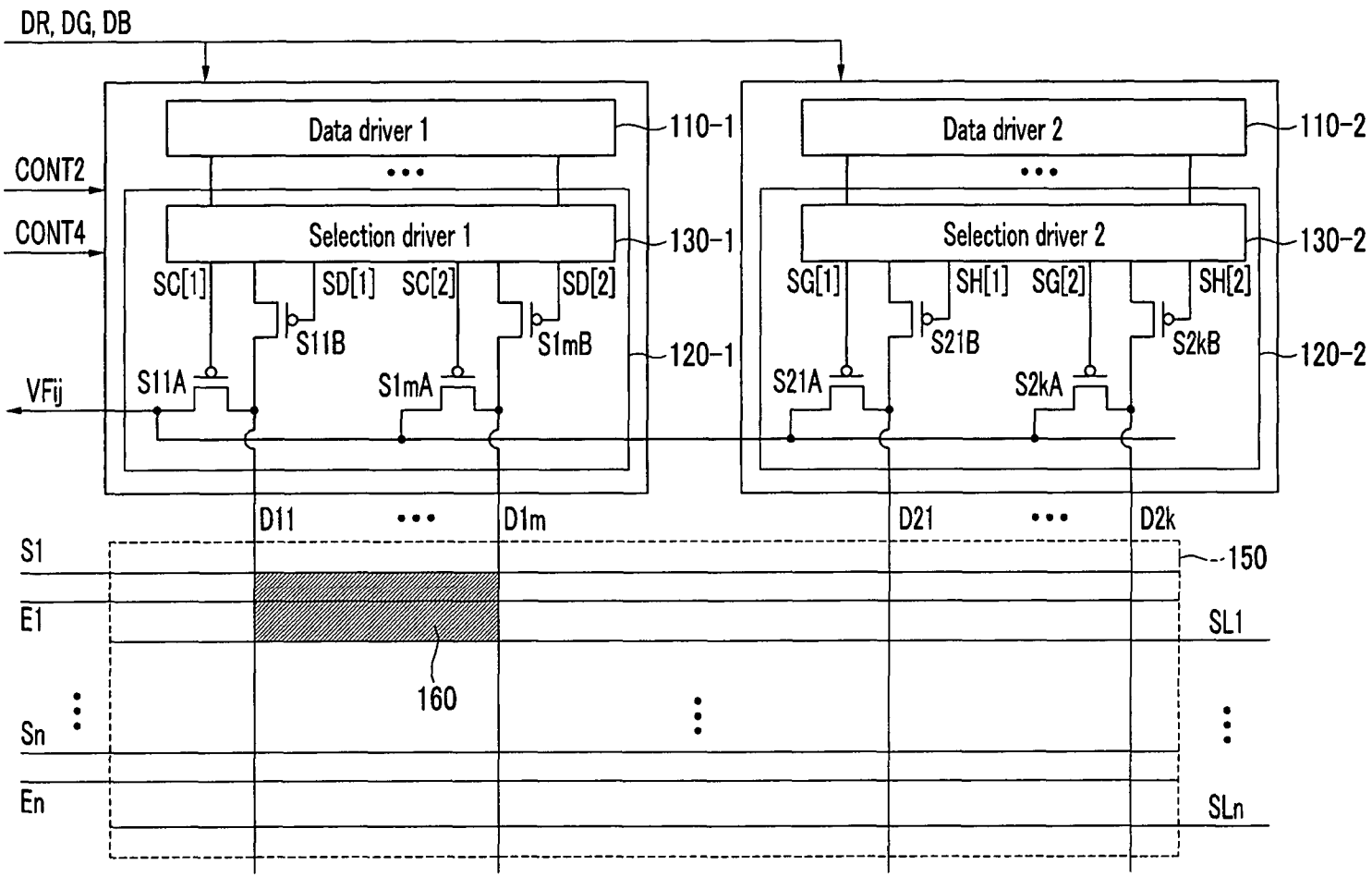
FIG. 8 illustrates a block diagram of a display device according to another exemplary embodiment.

In FIG. 8, for better understanding and ease of description, only two data drivers 110-1 and 110-2 and two selection units 120-1 and 120-2 corresponding thereto are shown. However, embodiments are not limited thereto, and the number of data drivers and selection units may be appropriately changed according to the size of the panel and the number of data lines according thereto, i.e., the number of channels.

Two selection units 120-1 and 120-2 turn on the plurality of data transmitting switches S1*i*B and S2*j*B (i is a natural number from 1 to m, and j is a natural number from 1 to k) during the image display period. Accordingly, a plurality of data signals output from the two data drivers 110-1 and 110-2 are respectively transmitted to the corresponding data lines.

The selection units 110-1 and 110-2 turn on the plurality of compensating switches through the same method as of the previous exemplary embodiment during the sensing period to measure the driving voltage of the organic light emitting diode.

Figure 9:
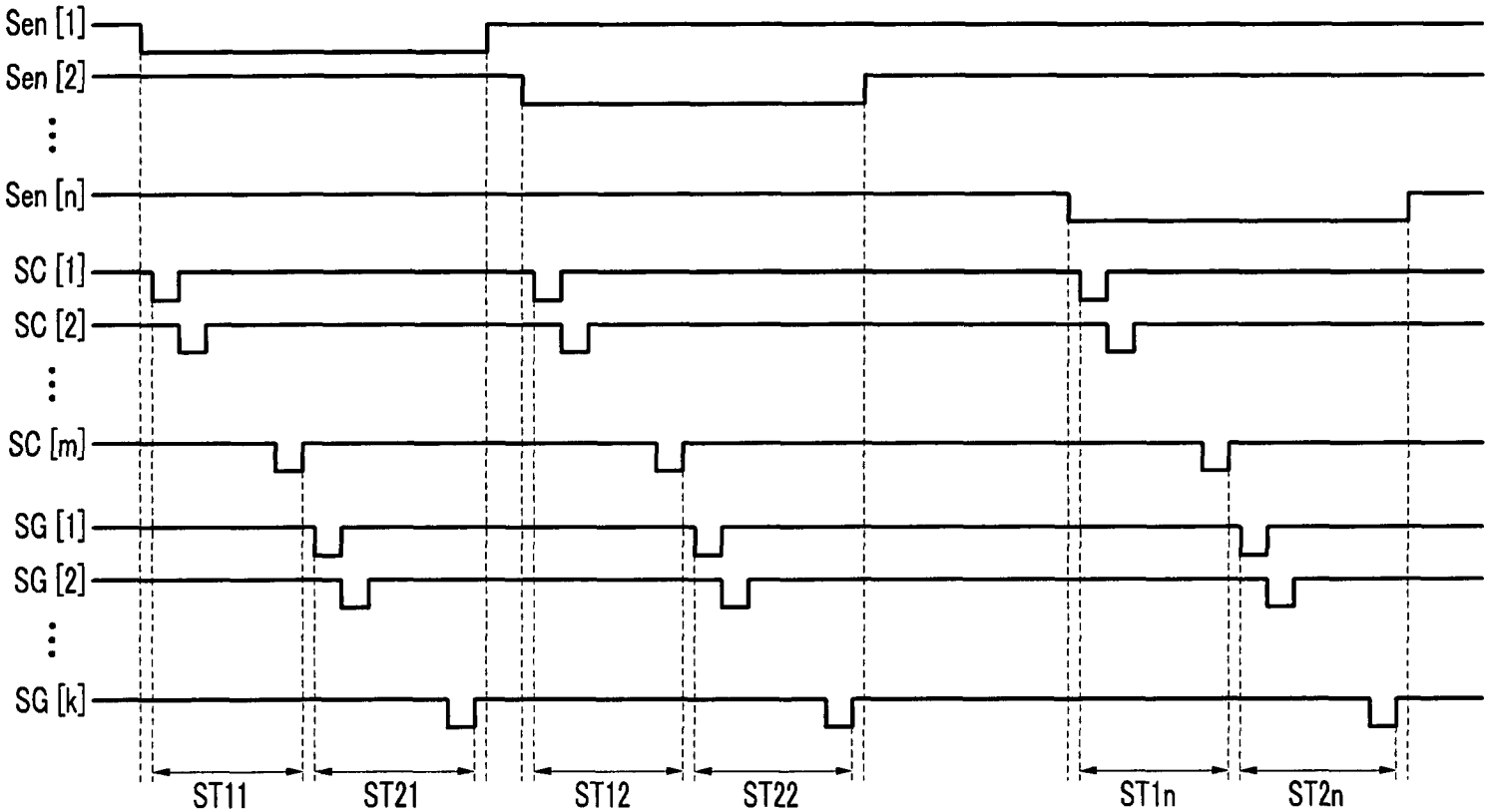
FIG. 9 and FIG. 10 illustrate waveforms of each signal according to another exemplary embodiment.

Referring to FIG. 9, the selection unit 120-1 is operated during the first sensing period ST11 of the sensing period such that each driving voltage of the plurality of organic light emitting diodes connected to the plurality of data lines D11-D1*m* corresponding to the selection unit 120-1 is transmitted to the compensation controller 400, and the selection unit 120-2 is operated during the second sensing period ST21 of the sensing period such that each driving voltage of the plurality of organic light emitting diodes connected to the plurality of data lines D21-D2*k* corresponding to the selection unit 120-2 is transmitted to the compensation controller 400. Here, the first sensing period ST11 and the second sensing period ST21 do not overlap with each other, and the first sensing period ST11 may be advanced or the second sensing period ST21 may be advanced.

For example, a plurality of compensating switches S1*i*A (i is a natural number from 1 to m) is turned on during the first sensing period ST1*i* (i is a natural number from 1 to n) among the period in which the sensing lines SL1 receive the detection signal Sen[1] at the low level, such that each driving voltage of the plurality of pixels connected to the plurality of data lines D11-D1*m* are transmitted to the compensation controller. Also, a plurality of compensating switches S2*j*A (j is a natural number from 1 to k) are turned on during the second sensing period ST2*i* (i is a natural number from 1 to n) among the period in which the sensing lines SL1 receive the detection signal Sen[1] at the low level, such that each driving voltage of the plurality of pixels connected to the plurality of data lines D11-D1*k* are transmitted to the compensation controller 400.

The above-described operation is repeated for the plurality of sensing lines. That is, the selection unit 120-1 and the selection unit 120-2 are alternately operated during the sensing period, and the period in which each selection unit is operated is indicated as the first sensing period ST1*i* (i is a natural number from 1 to n) and the second sensing period ST2*i* (i is a natural number from 1 to n). Accordingly, the n first sensing period ST1*i* (i is a natural number from 1 to n) and the n second sensing period ST2*i* (i is a natural number from 1 to n) exist during the sensing period.

Figure 10:
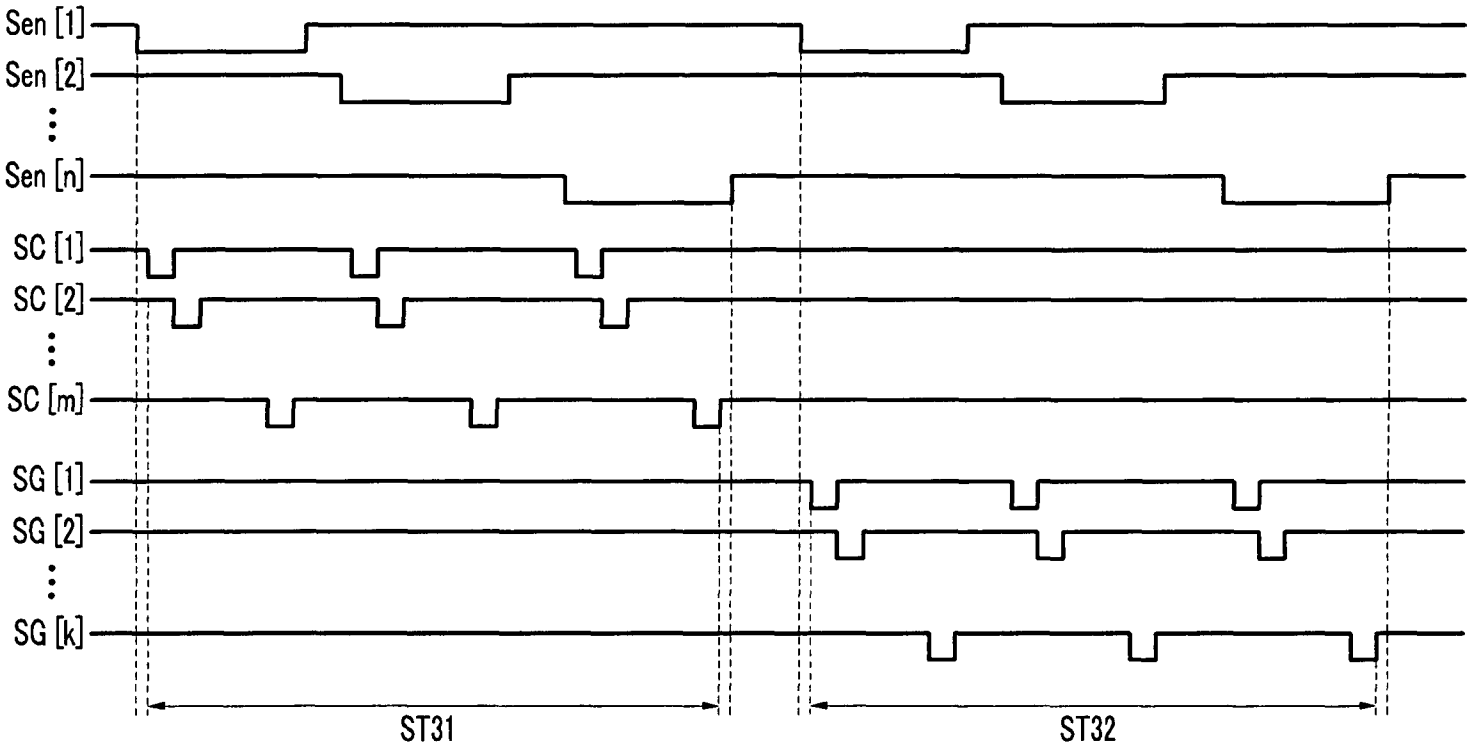

Alternatively, referring to FIG. 10, a plurality of compensating switches S1*i*A (i is a natural number from 1 to m) are turned on during the first sensing period ST31 among the period in which the sensing lines SL1 receive the detection signal Sen[1] at the low level, such that each driving voltage of the plurality of pixels connected to the plurality of data lines D11-D1*m* are transmitted to the compensation controller 400. Also, a plurality of compensating switches S2*j*A (j is a natural number from 1 to k) are turned on during the second sensing period ST32 such that each driving voltage of the plurality of pixels connected to the plurality of data lines D21-D2*k* is transmitted to the compensation controller 400.

Also, the plurality of compensating switches S1*i*A (i is a natural number from 1 to m) are turned on during the first sensing period ST31 of the period in which the detection signal Sen[2] having the low level is transmitted to the sensing lines SL2 such that each driving voltage of the plurality of pixels connected to the plurality of data lines D11-D1*m* is transmitted to the compensation controller 400. Also, a plurality of compensating switches S1*j*A (j is a natural number from 1 to k) are turned on during the second sensing period ST32 such that each driving voltage of the plurality of pixels connected to the plurality of data lines D21-D2*k* is transmitted to the compensation controller 400.

By repeating and executing this operation to the final sensing line, a plurality of compensating switches S1*i*A (i is a natural number from 1 to m) are turned on during the first sensing period ST31 among the period in which the sensing lines SLn receive the detection signal Sen[n] at the low level, such that each driving voltage of the plurality of pixels connected to the plurality of data lines D11-D1*m* is transmitted to the compensation controller 400. Also, the plurality of compensating switches S2*j*A (j is a natural number from 1 to k) are turned on during the second sensing period ST32, such that each driving voltage of the plurality of pixels connected to the plurality of data lines D21-D2*k* is transmitted to the compensation controller 400.

That is, the plurality of sensing lines receive the plurality of detection signals having the low level twice, i.e., a number of selection units, and the selection unit 120-1 may be operated first, followed by the selection unit 120-2. Alternatively, the selection unit 120-2 may be operated first, followed by the selection unit 120-1.

As a result, the first sensing period ST31 and the second sensing period ST32 are not alternately generated, and the plurality of second sensing periods ST32 may be generated after the first sensing periods ST31 are generated.

In the case of a large panel, a plurality of data drivers is required for one panel due to a limit of the number channels of the data driver. Here, when the plurality of data drivers respectively include the compensation driving circuit for compensating the deterioration of the organic light emitting diode, a compensation error caused by the deviation of the compensation driving circuit of the data driver may be generated.

According to embodiments, the driving voltage of the organic light emitting diode is measured using one converter and one current source such that compensation error may be prevented. Also, according to embodiments, the converter and the current source are disposed outside the data driver, such that the number of converters and current sources for a plurality of data drivers does not increase and, accordingly, compensation error may be prevented.

In an exemplary embodiment, the data driver 110, the selection unit 120, and the sensing driver 140 are disposed inside the panel unit 100, and the light emission driver 200 and the scan driver 300 are disposed outside the panel unit 100, however embodiments are not limited thereto, and may be applied when elements outside and inside the panel unit 100 are interchanged.

Also, while the time that the detection signal is decreased and the turn-on time of the first selection transistor are different from each other in the above embodiments, embodiments are not limited thereto, and may be applied when the decrease in the detection signal and turn-on of the first selection transistor are the same, and this is included in the scope of the present invention.

In embodiments described above, the selection transistors are sequentially turned on. However, embodiments are not limited thereto, and may be applied when at least two or more transistors are simultaneously turned on, and this is included in the scope of the present invention. In detail, this means that a plurality of data lines are simultaneously or sequentially supplied with the test current during the period in which the detection signal is maintained at the low level, such that the plurality of selection transistors are turned on for the driving voltage to be transmitted.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

| <Description of symbols> | |
|---|---|
| 100: | panel unit |
| 110: | data driver |
| 110-1: | data driver1 |
| 110-2: | data driver2 |
| 120: | selection unit |
| 120-1: | selection unit1 |
| 120-2: | selection unit2 |
| 130: | selection driver |
| 130-1: | selection driver1 |
| 130-2: | selection driver2 |
| 135: | selection line |
| 140: | sensing drive |
| 150: | display unit |
| 160: | pixel |
| 200: | light emission driver |
| 300: | scan driver |
| 400: | compensation controller |
| 410: | current source |
| 420: | converter |
| 430: | current switch |
| 500: | signal controller |

What is claimed is:

1. A display device, comprising:

a display unit including a plurality of pixels, a plurality of scan lines, and a plurality of data lines;

a data driver transmitting a plurality of data signals to the plurality of data lines;

a scan driver transmitting a plurality of scan signals to the plurality of scan lines;

a compensation controller supplying a predetermined test current to each organic light emitting diode in each of the plurality of pixels during a sensing period for measuring a driving voltage of the organic light emitting diode for each of the plurality of pixels, receiving the driving voltage of the organic light emitting diode supplied with the first current, and outputting measuring data for the transmitted driving voltage;

a signal controller compensating an input video signal according to the measuring data to generate image data, wherein the compensation controller is separate from and external to the data driver, wherein the compensation controller is connected to one data line of the plurality of data lines during the sensing period, and detects the driving voltage of at least one organic light emitting diode among the plurality of organic light emitting diodes connected to one data line; and a selection unit including:

a plurality of compensating switches including a first terminal connected to the corresponding data line of the plurality of data lines and a second terminal connected to the compensation controller;

a plurality of data transmitting switches including a first terminal connected to the corresponding data line of the plurality of data lines and a second terminal connected to the data driver; and a selection driver turning on the plurality of compensating switches during the sensing period, and turning on the plurality of data transmitting switches during the image display period in which the plurality of data lines are transmitted with the plurality of data signals.

2. The display device as claimed in claim 1, further comprising:

a plurality of sensing driving lines; and a sensing driver respectively transmitting a plurality of detection signals to the corresponding sensing driving line according to the sensing control signal, wherein the driving voltage of the organic light emitting diode (OLED) of each of the plurality of pixels is transmitted to the compensation controller during the sensing period of the plurality of detection signals.

3. The display device as claimed in claim 2, wherein the plurality of detection signals respectively have a pulse of a first level during the sensing period, and the plurality of first switches are turned on during a period in which the detection signal has the pulse of the first level.

4. The display device as claimed in claim 3, wherein the compensation controller includes:

a current source supplying the test current to the plurality of data lines during the sensing period; and a converter digitally-converting the driving voltage of the organic light emitting diode (OLED) transmitted through the plurality of data lines during the sensing period to output the measuring data.

5. A display device, comprising:

a display unit including a plurality of pixels, a plurality of scan lines, and a plurality of data lines;

a first data driver transmitting a plurality of corresponding data signals to the plurality of first data lines of the plurality of data lines;

a second data driver transmitting a plurality of corresponding data signals to the plurality of second data lines of the plurality of data lines except for the plurality of first data lines;

a scan driver transmitting a plurality of scan signals to the plurality of scan lines;

a compensation controller supplying a predetermined test current to each organic light emitting diode in each of the plurality of pixels during a sensing period for measuring a driving voltage of the organic light emitting diode for each of the plurality of pixels, receiving the driving voltage of the organic light emitting diode supplied with the first current, and outputting measuring data for the transmitted driving voltage;

a first selection unit connecting the plurality of first data lines to the compensation controller during a first sensing period of the sensing period;

a second selection unit connecting the plurality of second data lines to the compensation controller during a second sensing period of the sensing period; and a signal controller compensating an input video signal according to the measuring data to generate image data, wherein the compensation controller is separate from and external to both the first and second data drivers, and wherein at least one of the first and second selection units includes:

a plurality of compensating switches connected to a corresponding data line and the compensation controller;

a plurality of data transmitting switches connected to a corresponding data line and the data driver; and a sensing driver configured to transmit a detection signal having a first level during the first and second sensing periods, wherein the plurality of compensating switches are turned on during one of the first and second sensing periods.

6. The display device as claimed in claim 5, further comprising:

a plurality of sensing driving lines, wherein the sensing driver transmits a plurality of detection signals corresponding to the plurality of sensing driving lines during the sensing period.

7. The display device as claimed in claim 6, wherein the first selection unit includes:

a plurality of first compensating switches including a first terminal connected to the first data lines and a second terminal connected to the compensation controller; and a plurality of first data transmitting switches including a first terminal connected to the first data lines and a second terminal receiving the corresponding data signal from the data driver.

8. The display device as claimed in claim 7, wherein the first selection unit turns on the plurality of first compensating switches during the first sensing period.

9. The display device as claimed in claim 7, wherein:

the sensing driver transmits the detection signal having the first level to measure the driving voltage of the organic light emitting diode corresponding to one sensing driving line of the plurality of sensing driving lines during the sensing period;

the period in which the corresponding detection signal is at the first level includes the first sensing period and the second sensing period; and the first selection unit turns on the plurality of first compensating switches during the first sensing period.

10. The display device as claimed in claim 7, wherein:

the sensing driver transmits a plurality of detection signals at the first level to measure the driving voltage of the organic light emitting diode corresponding to the plurality of sensing driving lines during the first sensing period;

the sensing driver transmits the plurality of detection signals at the first level to measure the driving voltage of the organic light emitting diode corresponding to the plurality of sensing driving lines during the second sensing period; and the first selection unit turns on the plurality of first compensating switches at least two times during the first sensing period.

11. The display device as claimed in claim 6, wherein the second selection unit includes:

a plurality of second compensating switches including a first terminal connected to the second data lines and a second terminal connected to the compensation controller; and a plurality of second data transmitting switches including a first terminal connected to the second data lines and a second terminal receiving the corresponding data signal from the data driver.

12. The display device as claimed in claim 11, wherein the second selection unit turns on the plurality of second compensating switches during the second sensing period.

13. The display device as claimed in claim 11, wherein:

the sensing driver transmits the detection signal at the first level to measure the driving voltage of the organic light emitting diode corresponding to one sensing driving line of the plurality of sensing driving lines during the sensing period;

the period in which the corresponding detection signal is at the first level includes the first sensing period and the second sensing period; and the second selection unit turns on the plurality of second compensating switches during the second sensing period.

14. The display device as claimed in claim 11, wherein:

the sensing driver transmits a plurality of detection signals at the first level to measure the driving voltage of the organic light emitting diode corresponding to the plurality of sensing driving lines during the first sensing period;

the sensing driver transmits the plurality of detection signals at the first level to measure the driving voltage of the organic light emitting diode corresponding to the plurality of sensing driving lines during the second sensing period; and the second selection unit turns on the plurality of second compensating switches at least two times during the second sensing period.

15. The display device as claimed in claim 6, wherein:

the plurality of scan lines extend parallel to each other in a first direction, the plurality of data lines extend parallel to each other in a second direction intersecting the first direction, and the plurality of sensing driving lines are parallel to the corresponding scan lines of the plurality of scan lines.

16. A method of driving a display device including a display panel having a plurality of scan lines, a plurality of data lines, a plurality of organic light emitting diodes (OLED) corresponding to the data lines and scan lines, and a converter, and displaying images according to an input video signal, comprising:

transmitting a predetermined test current to an organic light emitting diode corresponding to one data line through one data line of the plurality of data lines;

transmitting a driving voltage of the corresponding organic light emitting diode generated when a test current flows in the corresponding organic light emitting diode to the converter;

repeating transmitting of the test current to the corresponding organic light emitting diode and transmitting of the driving voltage of the corresponding organic light emitting diode to the converter for the plurality of other data lines of the plurality of data lines, wherein repeating transmitting includes turning on a plurality of compensating switches to select respective data lines during a sensing period; and turning on a plurality of data transmitting switches to select respective data lines to receive data signals in accordance with the input video signal during an image display period.

17. The method as claimed in claim 6, further comprising:

transmitting a test current to the plurality of data lines corresponding to the plurality of organic light emitting diodes arranged in a direction in which a plurality of scan lines are formed; and receiving each driving voltage of the plurality of organic light emitting diodes through the plurality of data lines.

18. The method as claimed in claim 16, further comprising:

receiving each driving voltage of the plurality of organic light emitting diodes;

compensating the input video signal using each driving voltage of the plurality of organic light emitting diodes; and generating image data corresponding to the plurality of organic light emitting diodes using compensated input video signal to be used as the data signals during the image display period.

* * * * *